United States Patent [19]

Trutner et al.

[11] 4,256,989

[45] Mar. 17, 1981

[54] INCANDESCENT LAMP WITH FILAMENT MOUNTING MEANS AND SOCKET ADAPTOR

[75] Inventors: Donald G. Trutner, Chatham; David Kovacs, Lake Hopatcong; Raymond P. Fontana, Waldwick, all of N.J.; Luke Thorington, Easton, Pa.

[73] Assignee: Duro Test Corporation, North Bergen, N.J.

[21] Appl. No.: 944,725

[22] Filed: Sep. 22, 1978

[51] Int. Cl.[3] ..... H01J 5/48; H01J 5/50

[52] U.S. Cl. ..... 313/318; 313/315; 339/75 R; 339/91 L; 339/186 R

[58] Field of Search ..... 313/315, 318; 339/75 R, 339/75 MP, 89 R, 186 R, 186 M, 187, 91 L, 65, 54

[56] References Cited

U.S. PATENT DOCUMENTS

| | | | |
|---|---|---|---|
| 1,967,878 | 7/1934 | Geiger et al. | 339/176 L |
| 2,006,155 | 6/1935 | Blake | 339/145 R |
| 2,121,886 | 6/1938 | Campdera et al. | 339/186 R |
| 2,813,922 | 11/1957 | Arnold | 313/318 X |
| 3,017,599 | 1/1962 | Loesch | 339/91 L |
| 3,105,730 | 10/1963 | Smith | 339/185 RL |
| 3,413,511 | 11/1968 | Plagge | 313/318 |
| 3,660,713 | 5/1972 | Leslie et al. | 313/318 |
| 3,749,960 | 7/1973 | Fuqua et al. | 313/318 |
| 3,898,506 | 8/1975 | Wright et al. | 313/318 |

FOREIGN PATENT DOCUMENTS

| | | | |
|---|---|---|---|
| 635625 | 1/1962 | Canada | 313/318 |

*Primary Examiner*—Saxfield Chatmon, Jr.
*Attorney, Agent, or Firm*—Darby & Darby

[57] ABSTRACT

An incandescent electric lamp having an envelope with a portion through which a pair of lead-in studs are brought out, the filament leads being connected to the studs. The lamp is sealed off in the area where the studs are located and an adaptor is provided to make contact with the portions of the studs extending through the envelope so that the lamp can be mounted in a socket.

19 Claims, 4 Drawing Figures

FIG. 1
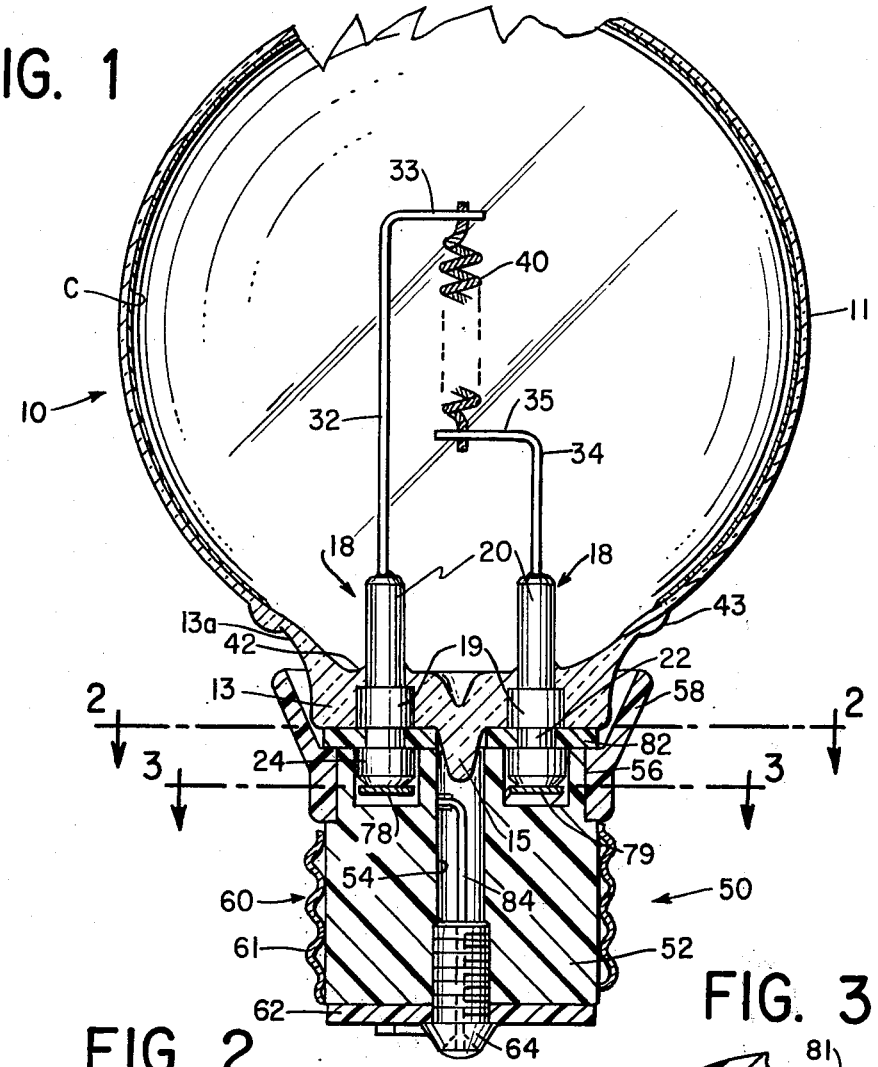
FIG. 2
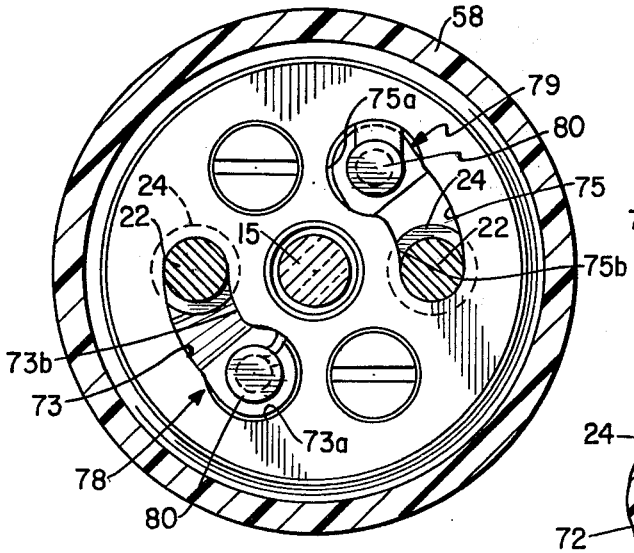
FIG. 3
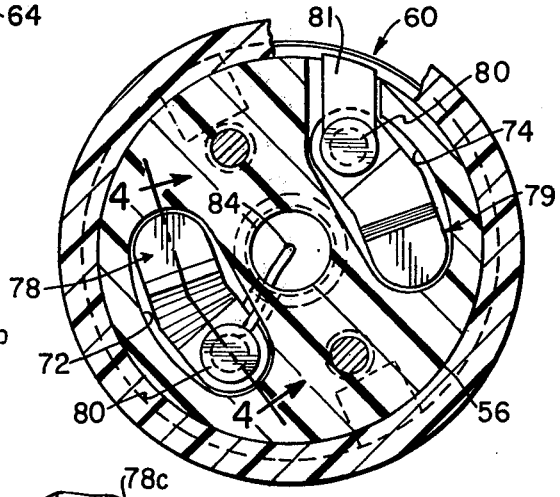
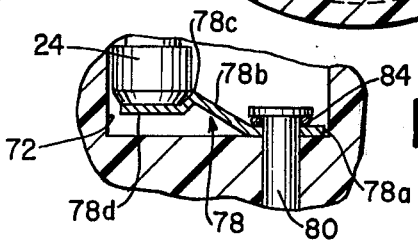
FIG. 4

INCANDESCENT LAMP WITH FILAMENT MOUNTING MEANS AND SOCKET ADAPTOR

The present invention relates to an incandescent electric lamp and more particularly to a type of lamp in which it is desired to mount the filament in a given location.

Conventional incandescent electric lamps are manufactured with a glass envelope having a reentrant stem portion of glass which extends into the interior of the envelope. The lead-ins for mounting the lamp filament are brought into the lamp through the stem and the filament is mounted thereon. Such a stem is adequate for high-speed assembly of lamps on automatic machinery. However, in conventional incandescent lamps, the filament need not be placed at any special location with respect to the interior of the envelope.

In various types of lamps, for example a lamp with a full or partial infrared (IR) energy reflective coating, two problems are encountered. First of all, the filament must be placed at a desired location within the interior of the envelope with respect to it. Normally, this will be at the optical center of the envelope so that IR energy can be reflected from the envelope back to the filament. It is also possible to mount the filament off-center in various applications. Neither type of precise location would be readily accomplished with a glass stem whose dimensions are quite variable at the temperatures encountered during some of the lamp processing steps. In addition, since large quantities of heat are present due to IR reflection at various portions of the envelope, the possibility arises that a glass stem might fully or partially melt.

Accordingly, the present invention relates to an incandescent lamp in which the conventional glass reentrant stem is eliminated. The lamp includes an envelope which is sealed off at a portion which is made structurally stronger than the remainder of the envelope and a pair of lead-in mounting studs are provided therethrough. Lead-in wires are connected to the lead-in mounting studs and the filament is connected to these wires. An adaptor socket is provided which connects to the lead-in studs so that the lamp may be mounted in a conventional base which supplies it with electrical current.

It is therefore an object of the present invention to provide an incandescent lamp with lead-in studs mounted to the envelope for the lead-in wires to mount the filament.

An additional object is to provide an incandescent electric lamp having lead-in studs mounted through a reinforced portion of the envelope wall.

Another object is to provide an incandescent electric lamp having lead-in studs to which the lead in wires are connected and the filament connected to the lead-in wires, with the lamp being provided with an adaptor base to which electrical contact can be made.

Other objects and advantages of the present invention will become more apparent upon reference to the following specification and annexed drawings in which:

FIG. 1 is an elevational view, partly in section, of the lamp and the adaptor socket;

FIG. 2 is a cross-sectional top view taken along lines 2—2;

FIG. 3 is a cross-sectional top view taken along lines 3—3 of FIG. 1; and

FIG. 4 is a fragmentary view, in cross-section, of a portion of the adaptor.

Referring to the drawings, the incandescent lamp 10 of the invention includes an envelope 11 of a conventional glass material, for example, lime glass or borosilicate glass. Envelope 11 is of generally spherical shape except for the bottom portion 13 thereof which is generally flat. The bottom portion 13 is reinforced with respect to the remainder of the envelope 11 by being made considerably thicker, for example, in the order of 3–8 times thicker.

Envelope 11 can be blown and/or molded. The flat portion 13 is formed with a tube 15 through which the envelope 11 can be exhausted and filled with a suitable fill gas for operating the lamp or through which the lamp can be evacuated for vacuum operation. Any suitable gas or vacuum operation can be used with the lamp, this forming no part of the invention itself.

All or a portion of the interior and/or exterior of envelope 11 can be coated with an IR reflective material which can also be light transmissive. This is shown diagrammatically by the letter C on the interior of the envelope. Since the particular type of coating is not a part of the invention, it is not described in detail.

Sealed into the base portion 13 of the envelope are a pair of lead-in studs 18 which are of a suitable, electrically conductive material, for example, brass, copper, etc. If desired, the portions of the studs 18 which extend into the envelope can be coated with a material which is reflective to IR energy, one such material being silver. Each stud 18 is of generally circular shape, although other shapes can be used, and has an enlarged diameter intermediate body portion 19 which is sealed to the thick base 13. Each stud also has a portion of narrow diameter 20 which extends through base 13 into the interior of envelope 11. Exterior to the envelope, each of the studs 18 has a reduced diameter portion 22. The exterior portion 24 of each stud terminates in an enlarged diameter head through which electrical contact is made.

Connected to the top end of each of the studs 18 is a respective lead-in wire 32 and 34. The wire is of any suitable material, for example, nickle or tungsten. The longer wire 32 has an inwardly bent over section 33 and the shorter wire 34 has an inwardly bent over section 35. The bottom end of each of the two wires 32 and 34 is connected to a respective stud 18 by any suitable means, for example, welding, brazing, etc.

A filament 40 has its ends connected to the respective portions 33 and 35 of the two lead-in wires 32 and 34. The connection is made by any suitable technique, for example, welding, crimping, staking, etc. Filament 40 can be of the single coiled, double-coiled or triple-coiled type. The latter is preferred for higher emissivity.

In the manufacture of the lamp 10, the base portion 13 is made separate from the remainder of the spherical envelope 11. The base 13 can be molded and the studs 18 are placed in holes formed in the base. The base has a slight upwardly flared portion **13*a* which thins out to the thickness of the remainder of envelope 11. The studs can be molded as part of the bores or held therein by glass solder as shown at 42. The studs are precisely located in the base 13, since the base is relatively thick and has good dimensional stability. Also, the studs 18** are thick and rigid and have good dimensional stability.

The wires 32 and 34 are then mounted to the studs together with the filament 40. At this particular point in time, the filament can be placed at a desired location, relative to the base 13 by, for example, bending one or both of the leads 32 and 34.

After the filament assembly is completed to base 13, the base 13 is assembled to the envelope 11. This is done by, for example, making a glass weld in the area shown as 43 around the entire circumference of the base 13 which is originally formed with a slight upward flare. At this point in time, it is still a possible to align the filament with respect to the wall of the envelope by, for example, placing an instrument through the tube 15. This would be difficult to do in a glass bulb which has only a re-entrant stem. The filament 40 can be adjusted to be located at the optical center of envelope 11 or at any other desired location, for example, off of the optical center by a desired amount.

After the filament is aligned in the desired manner, the envelope is exhuasted and/or filled with a fill gas, if this is desired, through the tube 15. The tube is then sealed and tipped off. The lamp is now completed.

FIGS. 1-4 show a preferred form of adaptor 50 for use with the lamp of FIG. 1. The adaptor includes a body portion 52 of an insulating material, such as plastic, which is generally cylindrical and has a central bore 54. The upper end of body 52 has a narrow shoulder area 56 and an upwardly flared skirt 58 is placed in the area 56. It is held, for example, by an adhesive. The upwardly flared skirt 58 protects the bottom of the envelope base 13 and to provide a more aesthetic design.

Attached to the outside of the main portion of the body 50, by an adhesive or by a mechanical lock, is a shell 60 of aluminum, brass or other suitably electrically conductive material having screw threads 61 thereon. A washer 62 of electrically insulating material such as plastic, fiber or other similar material, is placed at the bottom of the body and the end of a stud 64 of electrically conductive material such as copper or brass, is received in and held by the central bore 54. This can be by a force fit, adhesive, etc. The shell 60 and stud 64 form electrical contacts, the same as in a conventional electric lamp, so that electrical contact can be made to contacts in a conventional socket (not shown). As also seen in FIG. 1, the end of the envelope stem 15 is received in and protected by the bore 54.

The top of the adaptor body 50 is formed with two arcuate key slots 72,74 in each of which a respective electrical contact member 78 is located. Attached to the top of the body is a washer 82 of an electrically insulating material. The washer is attached by an adhesive or heat sealing. It also has a pair of slots 73,75 corresponding to and overlying slots 72,74. Each slot 73,75 has a respective wide mouthed entry portion **73*a*,75*a* and arespctive narrow neck locking portion 73*b*,75*b*. The contact 78,79 each are of a spring type of material, for example, phospor-bronze, etc. Each of the electrical contacts 78,79 is held within a respective slot 72,74 by, for example, a rivet 80 which is embedded in the body 50 (See FIG. 4). Each contact has a flat section (only contact 78 being shown in FIG. 4) 78*a* attached to the rivet 80, an angled central part 78*b* terminating in a ridge 78*c* and a platform 78*d*. Connected to the bottom end of the rivet 80 of the contact 78 is a wire 84 which runs through the central bore 54 and is electrically connected to the base button 64. Connected to the rivet 80 of contact 79 is a metal tab 81 which is bent over and electrically connected to the shell 61**, for example, by soldering or welding.

To connect a lamp 10 to the adaptor 50, it is only necessary to place the enlarged diameter extending heads 24 of the studs 18 into the entry mouths **73*a*, 75*a* of the slots 73,75 of washer 80 until the reduced diameter areas 22 of the studs, which are slightly longer than the thickness of washer 80, are in a position to receive the washer. The lamp is then rotated to bring the stud heads 24 under the locking areas 73b,75*b* of the washer 82. The heads of the studs are larger than the openings 73*b*,75*b*. The lamp 10 is thus held securely against washer 80 by the stud heads 24 as the electrical spring contacts 78,79 apply an upward pressure against the studs. The bottom of each stud head is firmly seated on the respective platform 78*d*, 79*d* at the end of the respective contact member 78,79. The studs will then lock against the ribs of the contact members 78**.

What is claimed is:

1. A baseless incandescent electric lamp adapted for detachable mounting to an adaptor comprising:

an envelope of glass material, a pair of rigid studs of electrically conductive material hermetically sealed directly to a portion of said envelope, each stud being integrally formed with a first portion extending into the envelope and a second portion extending exterior of the envelope to which electrical contact is to be made with means in the adaptor to supply current to the lamp, said second portion of at least one of said studs formed with a reduced width portion intermediate the end of said second portion and the envelope for positively locking the lamp to the adaptor in a detachable manner, a wire electrically connected to the first portion of each of said studs, and an incandescent filament electrically connected between said wires.

2. An incandescent lamp as in claim 1 wherein the portion of the envelope to which the studs are sealed is substantially flat and a substantial portion of the remainder of the envelope is curved.

3. An incandescent lamp as in either of claims 1 or 2 wherein the portion of the envelope to which said studs are attached is of greater thickness than the remaining portion of the envelope.

4. An incandescent lamp as in claim 1 further comprising a tubulation formed on said envelope through which communication to the interior of the envelope is made before the tubulation is sealed.

5. An incandescent lamp as in claim 4 wherein the portion of the envelope to which the studs are attached and in which the tubulation is formed is substantially flat and a substantial portion of the remainder of the envelope is curved.

6. An incandescent lamp as in either of claims 4 or 5 wherein the portion of the envelope to which the studs are sealed and in which the tubulation is located is of greater thickness than the remainder of the envelope.

7. An incandescrnt lamp as in claim 2 wherein the portion of the envelope to which the studs are attached and the remainder of the envelope are separate pieces, and means for joining said separate pieces together.

8. An incandescent lamp as in claim 5 wherein the portion of the envelope to which the studs are attached and the remainder of the envelope are separate pieces, and means for joining said separate pieces together.

9. The combination of a baseless incandescent electric lamp and adaptor, said lamp including:

an envelope of a glass material having a bottom portion, a pair of rigid filament wire mount means of electrically conductive material hermetically sealed to said bottom portion of said envelope, each mount means having a first portion extending into the envelope and a second portion extending exterior of the envelope to which electrical contact is to be made to supply current to the lamp, the second portion of at least one of said mount means also formed with a means for positively locking the lamp to the adaptor, a wire electrically connected to the first portion of each of said mount means, and an incandescent filament electrically connected between said wires, said adaptor including a body of electrical insulating material, means on said body for receiving the bottom portion of said envelope and mating means on said body for receiving the locking means of the second portion of said at least one filament mount means to positively lock the lamp to said adaptor, said mating means comprising a pair of slots formed in one end of the body, at least one of said slots being arcuate, each slot for receiving the second portion of a respective filament mount means, and first means at at least one of said slots cooperating with the locking means on said at least one mount means for locking the second portions of the filament mount means in said slots, means for making electrical contact with the second portion of each of said mount means located in said slots, and means electrically connected to said means for making electrical contact for connecting said adaptor to a lamp socket.

10. The combination of claim 9 wherein the second portion of at least one of said mount means has a narrowed down section intermediate its end and the envelope, said adaptor locking means comprising first means on said one end of the body having a pair of slots which overlie the slots of the body, the slot of said first means overlying the arcuate slot of the body having a keyhole shape so that the narrowed down section of the second portion of said at least one mount means will be locked by the first means as said at least one mount means is placed in the keyhole slot and rotated to the narrow portion thereof.

11. The combination of claim 10 wherein said second portions of both said mount means has a narrowed known section and both said slots of said first means are keyhole shaped.

12. The combination of claim 9 wherein said first means comprises a cover which is detachable from said body means and has the keyhole shaped slot formed therein.

13. The combination of claim 10 wherein said first means comprises a cover which is detachable from said body means and has the keyhole shaped slots formed therein.

14. An incandescent lamp as in claim 9 wherein each of said mount means comprises a stud, the second portion of the stud having a section of reduced width between the end of each said second portion and the envelope to form at least a part of said positive locking means.

15. An adaptor for holding and making electrical contact with a baseless incandescent lamp of the type having a pair of rigid filament wire mount means of electrically conductive material which extend exterior of the envelope, said adaptor comprising:

a body of electrical insulating material, means on one end of said body for receiving and holding each of said filament mount means including a pair of slots into which the filament mount means extend, at least one of said slots being arcuate, first means in each of said slots for making electrical contact with a respective one of said electrically conductive filament mount means, means electrically connected to each of said first means for connecting said adaptor and therefore the lamp held thereby to a lamp socket, and means at said one end of said body for locking the lamp to the adaptor including a portion formed over said one arcuate slot having a keyhole shape to engage and lock a part of the filament mount means inserted into the arcuate slot as it is rotated from the wider to the narrower part of the keyhole slot as the lamp is rotated into said adaptor.

16. An adaptor as in claim 15 wherein both of the slots of the adaptor are arcuate in shape, a keyhole slot of said locking means formed over each of said arcuate slots.

17. An adaptor as in claim 15 wherein the locking means comprises a cover member which is separately attachable to said one end of the body.

18. An adaptor as in claim 16 wherein the locking means comprises a cover member which is separately attachable to said one end of the body and has the keyhole shaped slots formed therein.

19. The combination of claim 17 wherein both said slots of said cover are keyhole shaped to lock both said mount means.

* * * * *